US005524851A

United States Patent [19]

Huang

[11] Patent Number: 5,524,851

[45] Date of Patent: Jun. 11, 1996

[54] KITE ASSEMBLY

[76] Inventor: Ching-Chen Huang, 4 Fl. 67 No. Chung Cheng Rd., San Hsia Chen, Taipei Shyuan, Taiwan

[21] Appl. No.: 406,531

[22] Filed: Mar. 20, 1995

[51] Int. Cl.[6] ..... B64C 31/06

[52] U.S. Cl. ..... 244/153 R; 446/61; 446/489

[58] Field of Search ..... 244/153 R, 154, 244/155 R, 155 A; 446/128, 487, 488, 61, 66

[56] References Cited

U.S. PATENT DOCUMENTS

| | | | |
|---|---|---|---|
| D. 619,757 | 2/1899 | Johnstone et al. | 446/488 |
| 2,442,417 | 6/1948 | Lang | 244/153 R |
| 4,354,647 | 10/1982 | Carpenter | 244/153 R |
| 4,911,384 | 3/1990 | Stankus | 244/154 |
| 5,000,401 | 3/1991 | Barone | 244/153 R |

*Primary Examiner*—Galen L. Barefoot
*Attorney, Agent, or Firm*—Jacobson, Price, Holman & Stern

[57] ABSTRACT

A kite assembly has a main truss made of sheet material and attachable/detachable wings. The wings have a row of slots which fit over a corresponding row of hooks formed along the top edge of the main truss. The wings can be moved back and forth on the main truss for attachment and detachment. A reinforcing bar is mounted on the wings and fits in a hook eye formed in one of the hooks. The kite can be made in eye-catching configurations simulating birds in flight.

8 Claims, 7 Drawing Sheets

KITE ASSEMBLY

FIELD OF THE INVENTION

This invention relates to a kite, more particularly, to a kite assembly which can be readily assembled for use or disassembled when not in use. The kite assembly comprises a truss and wings which can be conveniently assembled. The assembly flies stably in the sky and is easy to manufacture and control. In general, the kite assembly has certain advantages over conventional kites.

A conventional kite generally comprises a truss and wings attached to the truss. There are a few kites which have no truss. Normally, the truss is made from light and tough material and the wings are made from cloth and are supported by and extended from the truss. Traditionally, the truss is made from bamboo. In order to catch the eye, many shapes have been made, such as birds, caterpillars, dragons and masks. If the figure has a curved portion, the bamboo may be preformed in a heat treatment, then shaped and finally cured. But a conventional kite can develop certain defects.

1. If the truss is made from bamboo, it may require heat treatment which is not suitable for mass production.

2. The balance of the kite is one of the most important factors in flying. Normally, bamboo cut by hand is difficult to balance on opposite side of the kite. Accordingly, the quality of a kite made from bamboo is difficult to control. Consequently, its flight is not always smooth.

3. Except for a caterpillar or dragon kite, most kites have a planar configuration. This shape is not particularly eye-catching and it is therefore difficult to attract people to play with such kites.

4. In cubic kite, the truss is generally fixed and cannot be disassembled for storage. Also, the truss may be too weak to sustain deformation and damage.

SUMMARY OF THE INVENTION

It is an object of the invention to provide a kite assembly wherein a kite can be readily assembled to different figures.

It is another object of the invention to provide a kite assembly wherein the kite can be readily disassembled for storage and transportation.

It is still another object of the invention to provide a kite assembly wherein the kite displays excellent balance promoting smooth and stable flight.

It is yet another object of the invention to provide a kite assembly having wings formed as eye-catching figures.

BRIEF DESCRIPTION OF THE DRAWINGS

The structural and operational characteristics of the present invention and its advantages as compared to the known state of the prior art will be better understood from the following description, in conjunction with the attached drawings which show illustratively but not restrictively an example of a kite assembly. In the drawings.

DETAILED DESCRIPTION OF THE PREFERRED EMBODIMENTS

Figure 1:
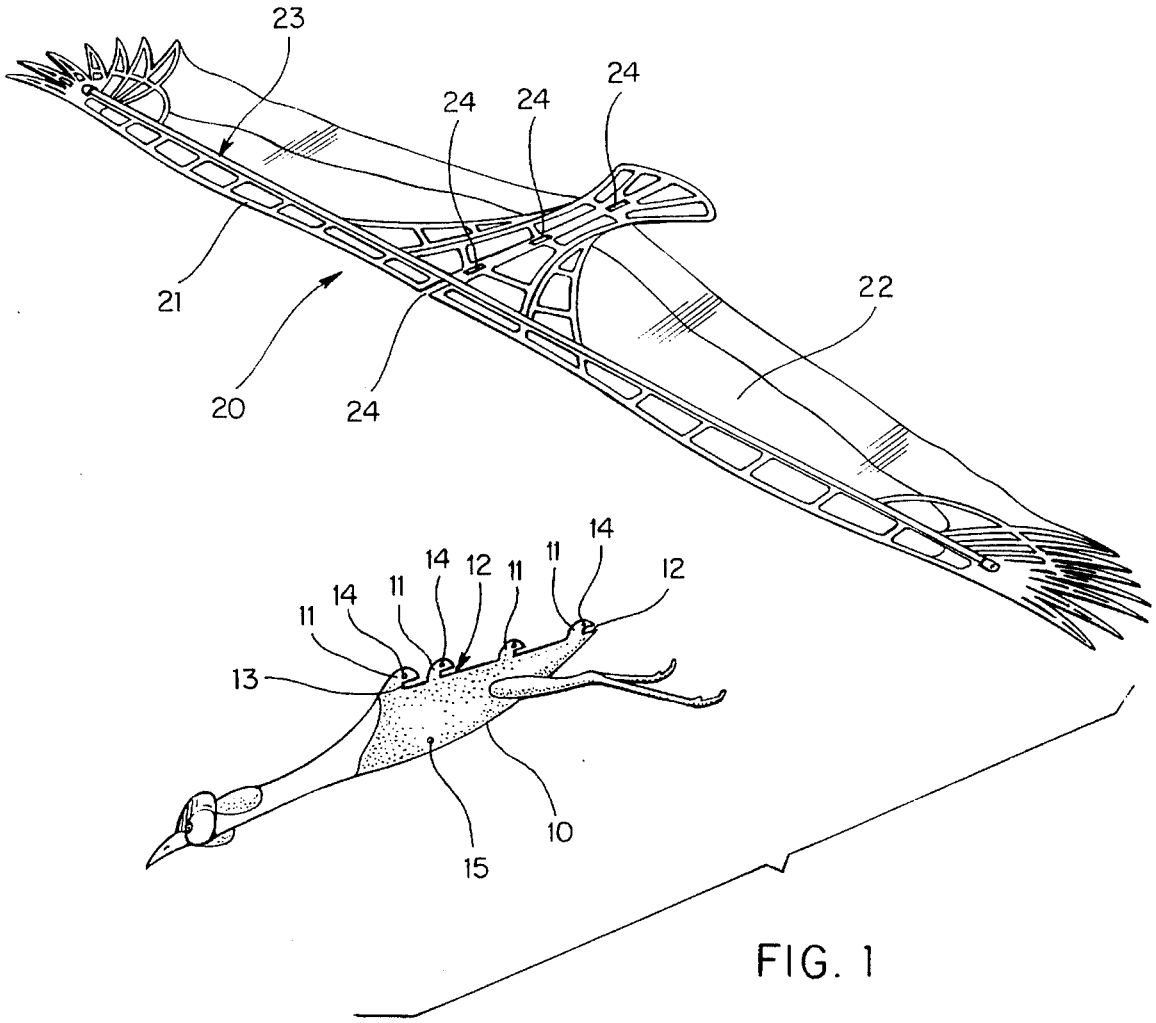
FIG. 1 is an exploded perspective view of a kite assembly according to the invention.

Referring to FIG. 1, a kite assembly according to the invention comprises a main truss 10 and wings 20. The main truss 10 can be made from plastic sheet, paper board, plywood, metal sheet or the like. The main truss 10 can be cut to form different figures, for example, a type of crane is shown in the drawings. The upper edge portion of the main truss 10 is provided with a plurality of hook-like clips 11. Each clip 11 defines a retaining slot 12 adjacent the upper portion of the main truss 10. The slot 12 extends in a rear-to-front direction. The forward-most clip 11 is provided with an hook-eye 13. In the upper portion of each clip 11, an eyelet 14 is provided. A hole 15 is formed in the bottom of said main truss 10.

Figure 2:
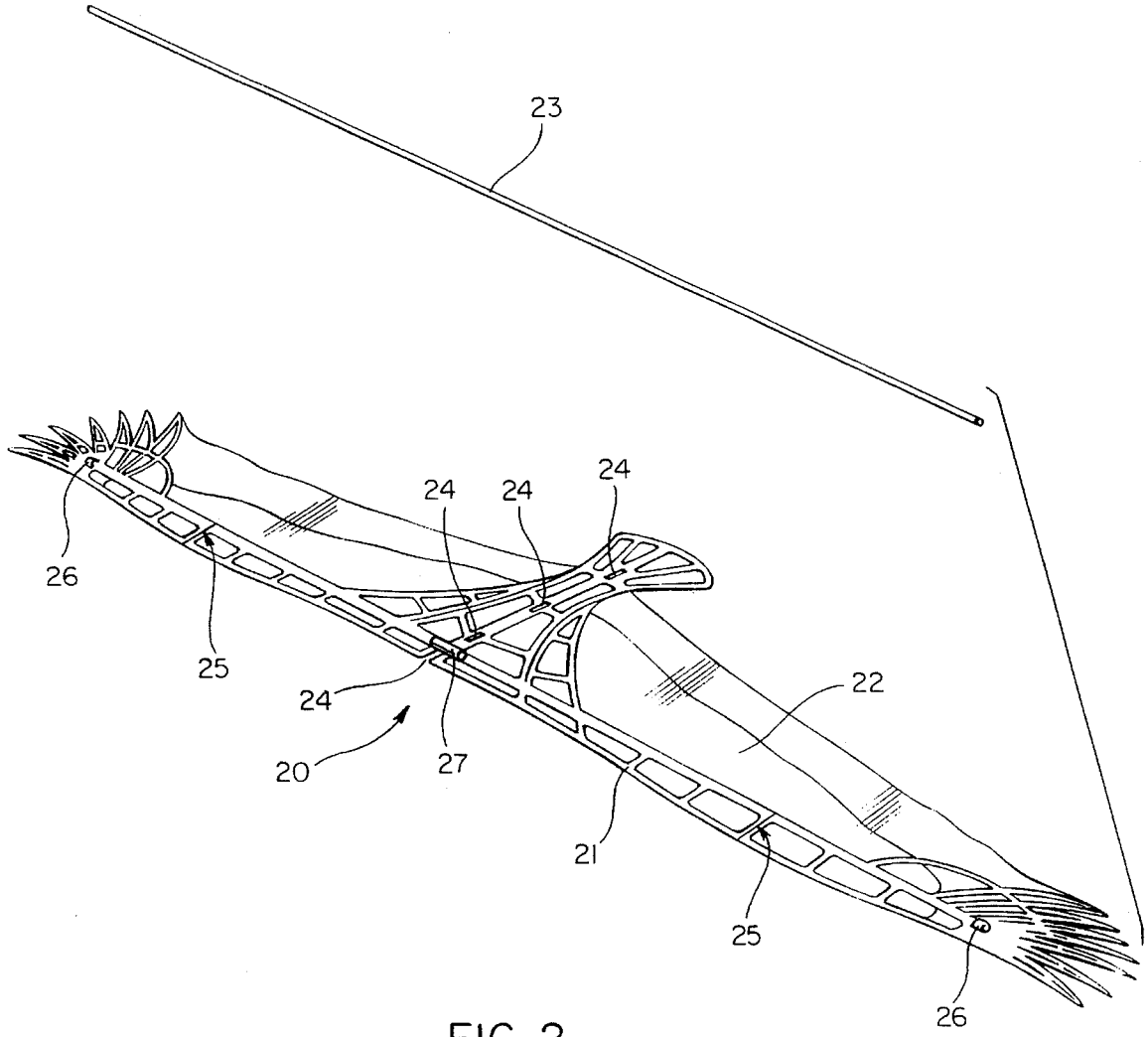
FIG. 2 is a perspective view showing a wing in the form of a crane.

The wings 20 have a conjugated configuration with the main truss 10. The wings comprise a frame 21 which can be made of the same material as said main truss 10. When the frame 21 is made, a cloth 22 is stretched and attached to the frame 21. The upper portion of frame 21 can be further reinforced with a rod 23 made from fiberglass or graphite fiber. The cloth 22 is made from thin and light material, such as cotton paper or fabric. The cloth 22 can be attached to the bottom of the frame 21. The wings 20 further incorporate a plurality of retaining notches 24 to receive the clips 11 of the truss 10. As shown in FIG. 2, a knuckle or hinge 25 is provided on each side of the frame 21 to facilitate folding of the frame. At opposite ends and in the central portion of the frame 21, sleeves 26 and 27 are provided. The sleeves 26 are closed at distal ends and the sleeve 27 has a passage therethrough. The passage provided by the sleeves 26, 27 is for receiving the reinforcing rod 23 to be connected with the wings.

Figure 3A:
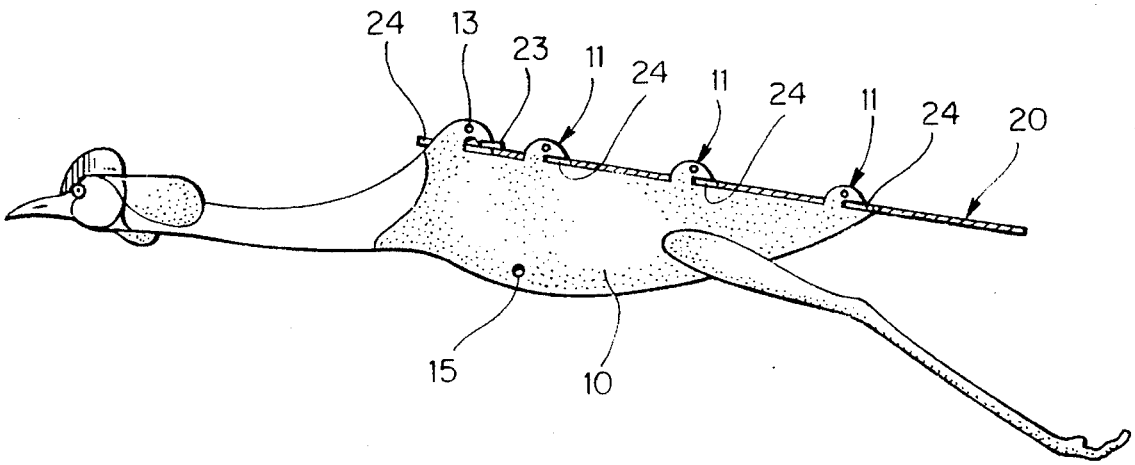
FIG. 3*a* and 3*b* are side views showing relative assembly motion of the wings and truss.
Figure 3B:
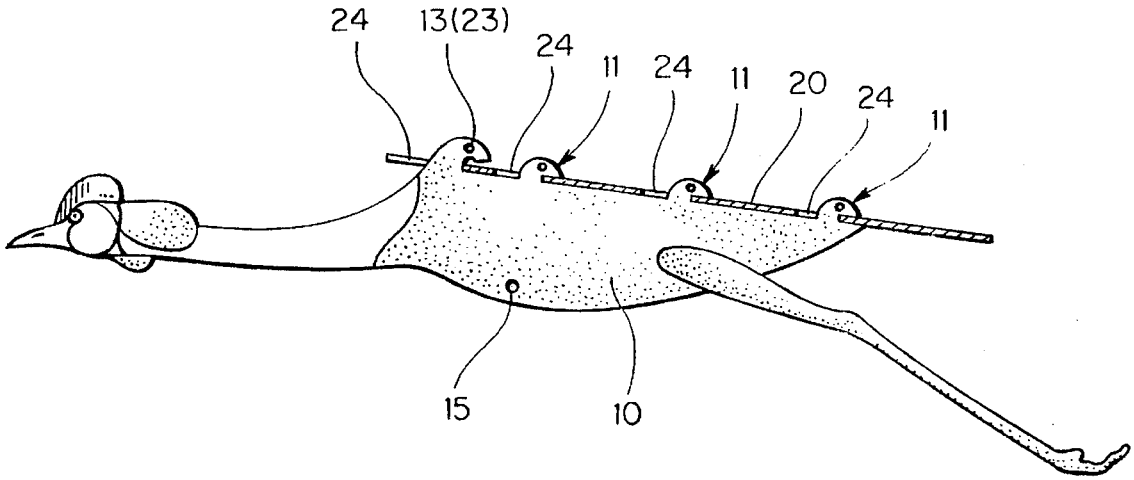

Referring to FIGS. 3*a* and 3*b*, the wings 20 and the main truss 10 are combined through the connection between the clips 11 and the retaining slots 24. First, the wings 20 are placed on main truss 10, as clearly shown in FIG. 3*a*, in a rearward position with the slots 24 received over the clips 11. Then the wings 20 are moved forward, FIG. 3*b* and the rod 23 (or sleeve 27) will pass along the slot 12 of the first clip 11 and become engaged in the hook-eye 13 with a press fit. The clips 11, also frictionally engage over the rear edges of slots 24 as clearly shown in FIG. 3*b*. By this arrangement, the kite is completely assembled.

After assembly, the wings 20 and the truss 10 will not separate because the reinforcing rod 23 (or sleeve 27) is engaged in the hook-eye 13. Thus, rigidity is further ensured.

Figure 4:
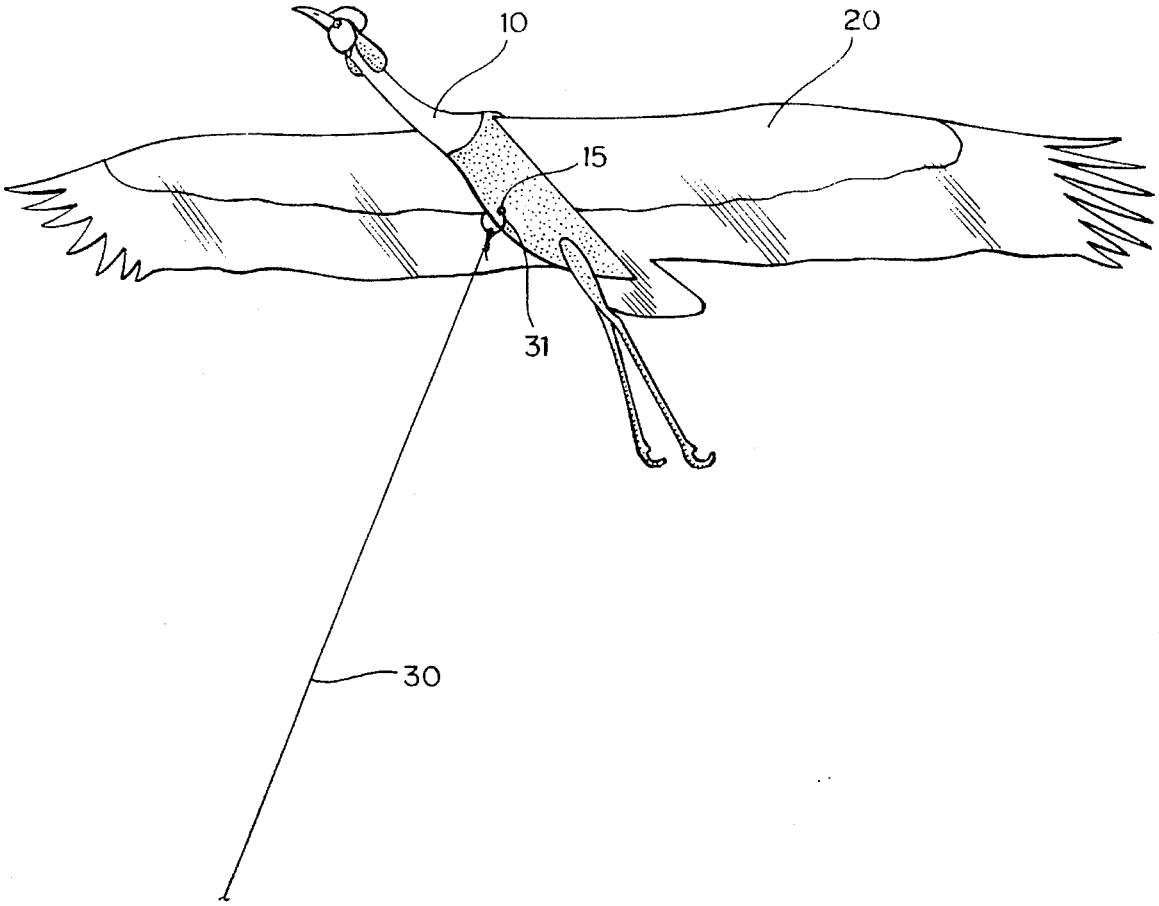
FIG. 4 is an underneath perspective view showing the kite being towed by a cable.

As shown in FIG. 4, when the wings 20 and the main truss 10 are assembled, an eye-catching kite figure is produced. The kite assembly can be readily manipulated with a controlling cable 30 attached to the main frame 10 at hole 15. A releasable hook element 31 can be incorporated in the cable 30 to provide a quick connect/release between the cable 30 and the kite. Accordingly, the kite assembly can fly stably in the sky.

Figure 5:
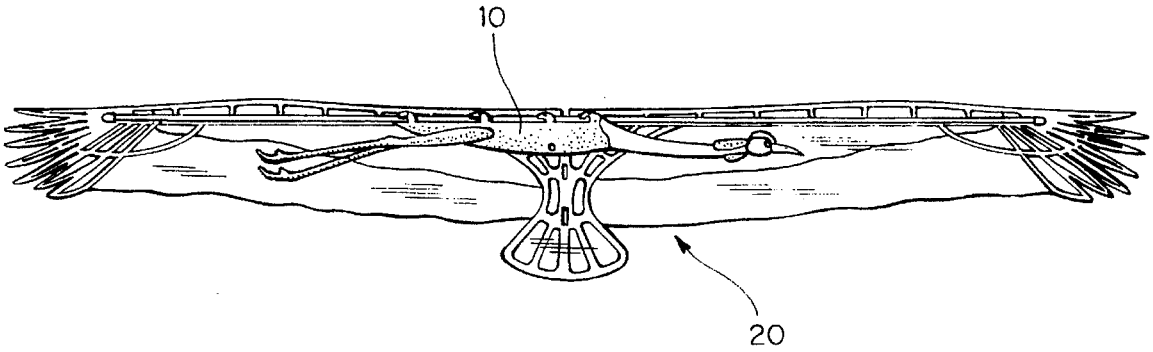
FIG. 5 is a side view showing how the kite disassembled.

When the kite assembly is not in use, the cable 30 can be disconnected first, then the wings 20 can be moved backward in such a manner that rod 23 is released from hook-eye 13 and retaining slot 12. The retaining slots 24 are also released from the clips 11. Accordingly, the main truss 10 and the wings 20 are disassembled. As shown in FIG. 5, the wings 20 and the main truss 10 can be placed in a planar configuration for storage or transportation.

Figure 6:
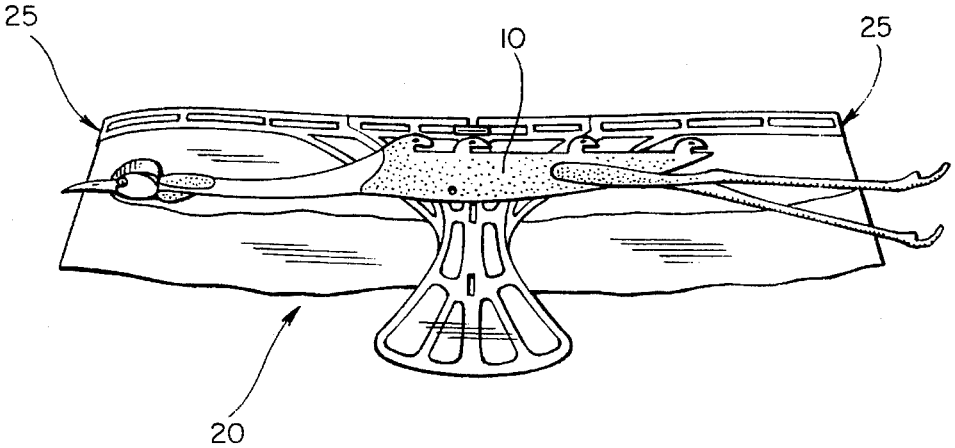
FIG. 6 is a side view showing how the truss and the wings are kept together.

As shown in FIG. 6, the wings 20 have another configuration when the rod 23 is withdrawn from sleeves 26, 27. Thus, the wings 20 may fold together along the knuckles 25. The size is thus decreased for convenient storage or transportation.

Figure 7:
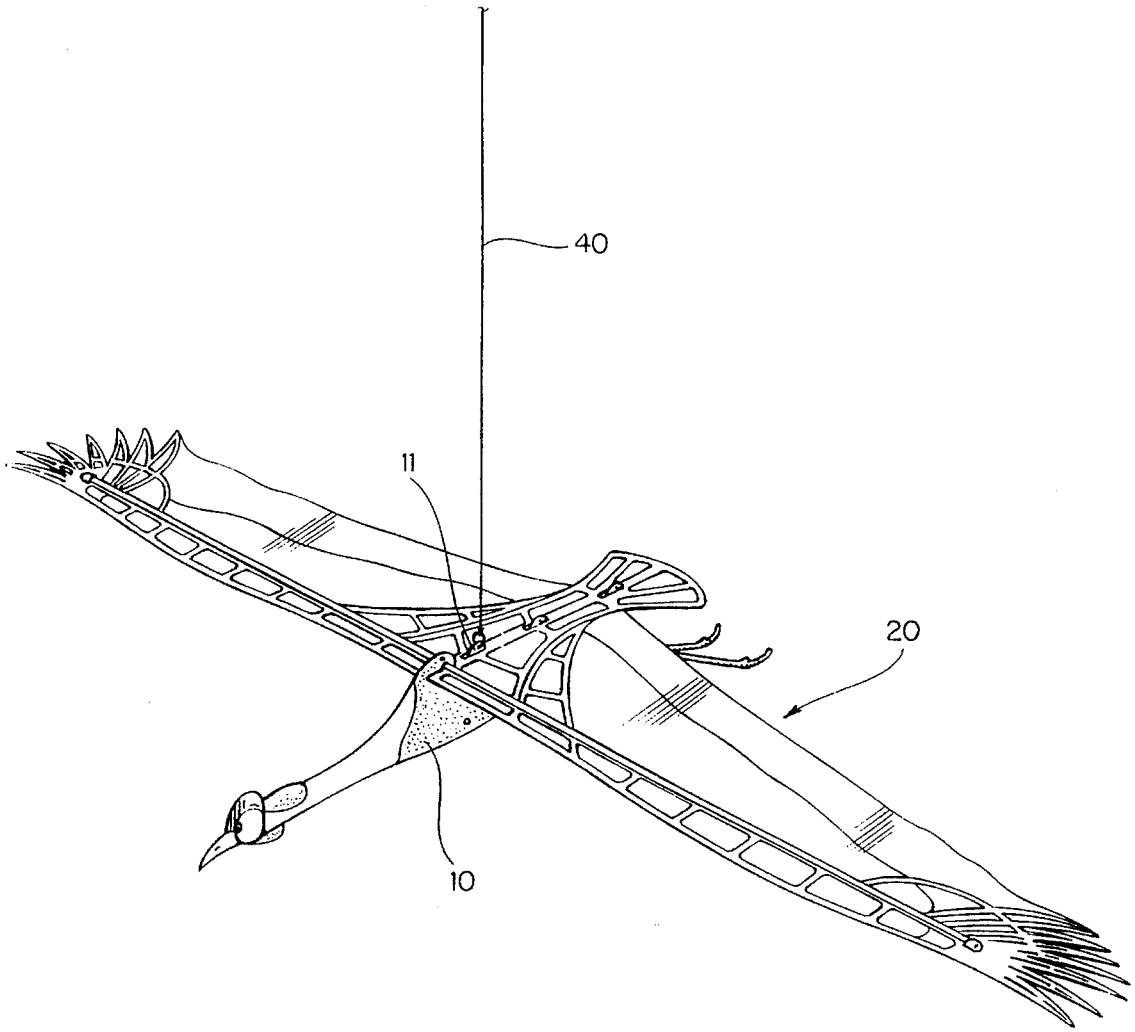
FIG. 7 is a top perspective view showing the kite being towed by a cable.

As shown in FIG. 7, the kite assembly can be suspended from an eyelet 14 of a clip 11 of said main truss 10. The kite assembly can thus be used as a decoration or display.

Figure 8:
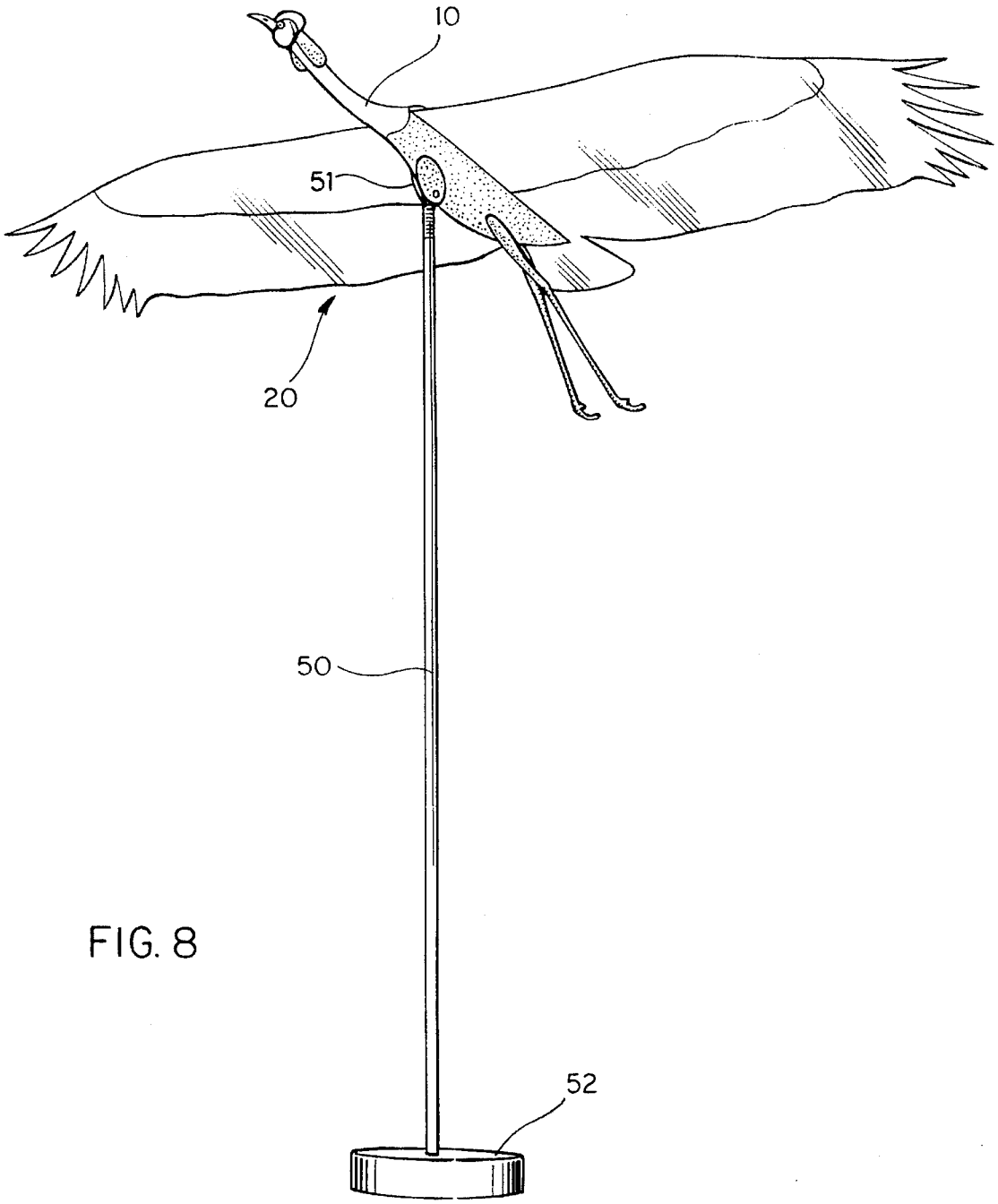
FIG. 8 is a perspective view showing the kite supported on a stand.

As shown in FIG. 8, the kite assembly can be readily supported on a stand 52 including a post 50 with a spring fastener 51 at its top. The main truss 10 can be firmly attached to said fastener 51. Accordingly, another effect is reached.

The main truss 10 and the wings 20 can be designed in many different shapes and forms of birds or other flying beings or objects.

The invention has the following features or advantages.

1. The main truss 10 and wings 20 can be readily made from suitable material via mechanical means, such as punching. By use of the reinforcing rod 23, the kite assembly can be readily assembled, making mass production feasible. The cost may be lowered and the quality can be ensured.

2. The balance can be readily controlled and achieved, accordingly, the kite assembly may fly stably and smoothly in the sky.

3. The assembling or disassembling can be readily done. Once the kite assembly is disassembled, the size can be reduced for easy storage or transportation, with the wings and main truss free from damage.

4. The kite assembly has an excellent eye-catching effect when it flies in the sky.

Although the present invention has been described in connection with the preferred embodiment thereof, many other variations and modifications will now become apparent to those skilled in the art without departing from the scope of the invention. It is preferred, therefore, that the present invention not be limited by the specific disclosure herein, but only by the appended claim.

I claim:

1. A kite assembly comprising a main truss and attachable/detachable wings, the main truss being formed of sheet material having a top edge, a row of hook-like clips formed along said top edge, at least one of the clips including a hook eye, the wings including a row of slots to fit over said clips, the slots each being of a length enabling the wings to be moved longitudinally along the top edge of the main truss when the clips are fitted in said slots to engage/disengage the clips over edge portions of the slots for attaching/detaching the wings and the main truss, and the assembly further including a reinforcing rod and mounting means for securing the reinforcing rod on the wings transversely in relation to said row of slots for engaging/disengaging a central portion of the rod with respect to said hook-eye when the wings are attached/detached with respect to the main truss.

2. An assembly as claimed in claim 1 wherein the main truss is shaped to simulate a bird.

3. An assembly as claimed in claim 1 wherein the wings comprise a frame covered with a sheet material.

4. An assembly as claimed in claim 1 wherein the mounting means comprises respective mounting sleeves on the wings for opposite ends of the rod.

5. An assembly as claimed in claim 4 including a further sleeve on the wings to receive said central portion of the rod, said further sleeve being engageable/disengageable with respect to said hook-eye.

6. An assembly as claimed in claim 1 including an attachment eyelet in at least one of said clips.

7. An assembly as claimed in claim 1 including an attachment aperture in the main truss.

8. An assembly as claimed in claim 1 wherein the wings include plural foldable sections and hinge means connecting the sections for folding the wings into a compacted configuration.

* * * * *